US006175991B1

(12) United States Patent
Driesman et al.

(10) Patent No.: US 6,175,991 B1
(45) Date of Patent: Jan. 23, 2001

(54) ARTICULATED DOOR HINGE FOR AN AUTOMOTIVE VEHICLE

(75) Inventors: David E. Driesman, North York; Felix S. H. Kim, Scarborough, both of (CA); Kevin Paul Vogler, Bloomfield Hills; Michael H. Kim, Dearborn, both of MI (US)

(73) Assignee: Ford Global Technologies, Inc., Dearborn, MI (US)

( * ) Notice: Under 35 U.S.C. 154(b), the term of this patent shall be extended for 0 days.

(21) Appl. No.: 09/152,306

(22) Filed: Sep. 14, 1998

(51) Int. Cl.[7] ..... E05D 3/08

(52) U.S. Cl. ..... 16/366; 16/370; 296/146.11; 296/146.12

(58) Field of Search ..... 16/366, 370, 221; 296/146.11, 146.12

(56) References Cited

U.S. PATENT DOCUMENTS

| | | | | |
|---|---|---|---|---|
| 2,901,766 | | 9/1959 | Marquis . | |
| 2,955,871 | | 10/1960 | Himka . | |
| 3,074,755 | | 1/1963 | Peras . | |
| 4,650,241 | | 3/1987 | Motonami et al. . | |
| 4,700,984 | | 10/1987 | Kinaga et al. | 16/370 |
| 4,854,010 | * | 8/1989 | Maraghe et al. | 16/370 |
| 5,491,875 | * | 2/1996 | Siladke et al. | 296/146.12 |
| 5,497,534 | * | 3/1996 | Caruso | 16/370 |
| 5,544,449 | * | 8/1996 | Amelio et al. | 16/366 |

FOREIGN PATENT DOCUMENTS

| | | | | |
|---|---|---|---|---|
| 2234 | * | 3/1910 | (GB) | 16/370 |
| 181251 | * | 6/1922 | (GB) | 16/37 |

* cited by examiner

*Primary Examiner*—Anthony Knight
*Assistant Examiner*—Mark Williams
(74) *Attorney, Agent, or Firm*—David B. Kelley

(57) ABSTRACT

An articulated door hinge attaching a vehicle door having an outer surface with a leading edge and an inner surface to a vehicle pillar having an outer surface and an inner surface, the door hinge including a pillar half linkage having a base rigidly attached to the pillar inner surface and a bearing surface projecting from the base supporting a pair of horizontally spaced rotary center shafts, a door half linkage having a base rigidly attached to the door inner surface and a bearing surface projecting from the base supporting a pair of horizontally spaced rotary center shafts, a forward link connecting corresponding longitudinally forward most rotary center shafts of the door half linkage to the pillar half linkage, and a rearward link connecting corresponding longitudinally rearward most rotary center shafts of the door half linkage to the pillar half linkage thereby creating an articulated door hinge, the articulated door hinge operable between a door closed position where the door outer surface leading edge is a predetermined distance from the pillar outer surface and a door open position where the door outer surface leading edge is moved laterally inward and longitudinally rearward of the pillar outer surface.

15 Claims, 3 Drawing Sheets

ARTICULATED DOOR HINGE FOR AN AUTOMOTIVE VEHICLE

FIELD OF THE INVENTION

The present invention relates to vehicle door hinges in general, and more specifically to an articulated vehicle door hinge.

BACKGROUND OF THE INVENTION

In most cases, the side door of an automotive vehicle is attached to the vehicle body with a conventional vehicle hinge. The vehicle door is adapted to rotate about the hinge for passenger ingress and egress to the vehicle passenger compartment. When using such a hinge there must be adequate space between the outer door leading edge and the adjacent pillar inner surface to allow the door to rotate about the hinge and open and close. Typically the pillar is formed with a cavity adjacent to the outer door leading edge to provide for such clearance.

It has become commercially desirable to provide in pickup and light commercial trucks a third and often fourth vehicle door attached to a B or C-pillar. As is often the case, however, these pillars are structurally reinforced or are carriers for a vehicle feature that prohibits forming a cavity therein to allow clearance for the outer door leading edge upon opening and closing of such a door.

An articulated door hinge may be employed to remedy such a problem. One articulated door hinge uses an upper and lower hinge to attach the vehicle door to the vehicle body. Such a hinge, however, lacks structural integrity and upon opening the vehicle door, the door sags and does not provide the quality that present day consumers are accustomed to. Another articulated door hinge uses a pair of torsion reinforcement bars to connect the upper and lower hinge to provide structural integrity sufficient to prevent the door from sagging. This hinge, however, moves the outer door leading edge outwardly and longitudinally forward of the vehicle. This is a problem with many trucks and light commercial vehicle because the b-pillar often extends outwardly of the outer door leading edge and would therefore interfere with such movement. Furthermore, this hinge has uniquely manufactured body half and vehicle door half linkages as well as a lack of interchangeability between right and left side hinges, which adds undesirable cost and weight to the vehicle.

What is desired than is an articulated door hinge that prevents the outer door leading edge from interfering with any type of pillar structure upon door opening, is sufficiently structurally robust to prevent door sag upon door opening and has interchangeable components corresponding to door half and body half upper and lower hinges as well as corresponding right and left vehicle door hinges.

SUMMARY OF THE INVENTION

The present invention overcomes the disadvantages of the related art by providing an articulated door hinge attaching a vehicle door having an outer surface with a leading-edge and an inner surface to a vehicle pillar having an outer surface and an inner surface, the door hinge having a pillar half linkage having a base rigidly attached to the pillar inner surface and a bearing surface projecting from the base supporting a pair of horizontally spaced rotary center shafts, a door half linkage having a base rigidly attached to the door inner surface and a bearing surface projecting from the base supporting a pair of horizontally spaced rotary center shafts, a forward link connecting corresponding longitudinally forward most rotary center shafts of the door half linkage to the pillar half linkage, and a rearward link connecting corresponding longitudinally rearward most rotary center shafts of the door half linkage to the pillar half linkage thereby creating an articulated door hinge. The articulated door hinge is operable between a door closed position where the door outer surface leading edge is a predetermined distance from the pillar outer surface and a door open position where the door outer surface leading edge is moved laterally inward and longitudinally rearward of the pillar outer surface.

An object of the present invention is to provide an articulated door hinge for an automotive vehicle that prevents the outer door leading edge from interfering with any type of pillar structure upon door opening.

An advantage of the present invention is that the articulated door hinge is operable between a door closed position and a door open position where the door outer surface leading edge is moved laterally inward and longitudinally rearward of the pillar outer surface, thereby preventing the outer door leading edge from interfering with the pillar structure.

A feature of the present invention is to provide upper and lower articulated door hinges connected by a torsional support shaft. The torsional support shaft is advantageous in that it prevents door sag in all door open positions.

A further feature of the present invention is that the door half linkages as well as the body half linkages are interchangeable between upper and lower as well as right and left side vehicle doors. This interchangeability advantageously minimizes hinge complexity as well as cost.

BRIEF DESCRIPTION OF THE DRAWINGS

Other features and advantages of the present invention will become apparent to those skilled in the related arts upon reading the following description with reference to the accompanying drawings, in which.

DETAILED DESCRIPTION OF THE PREFERRED EMBODIMENT

Figure 1:
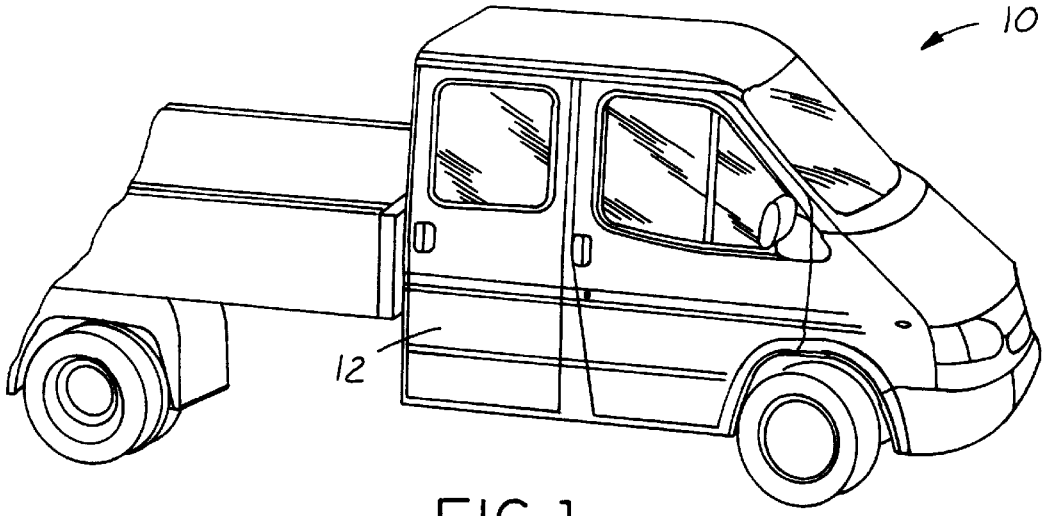
FIG. 1 is a side view of an automotive vehicle having a third door according to the present invention.
Figure 2:
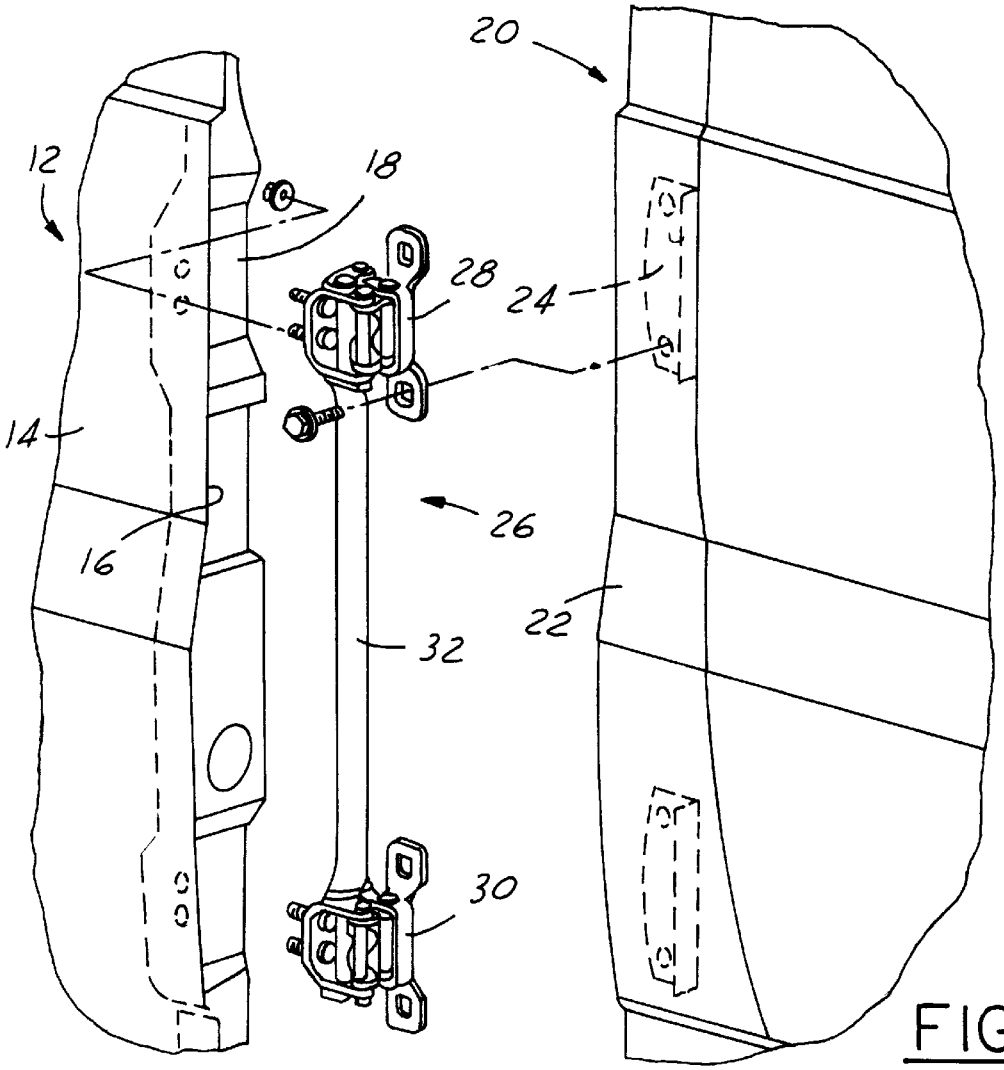
FIG. 2 is an exploded perspective view of an articulated door hinge according to the present invention.
Figure 3:
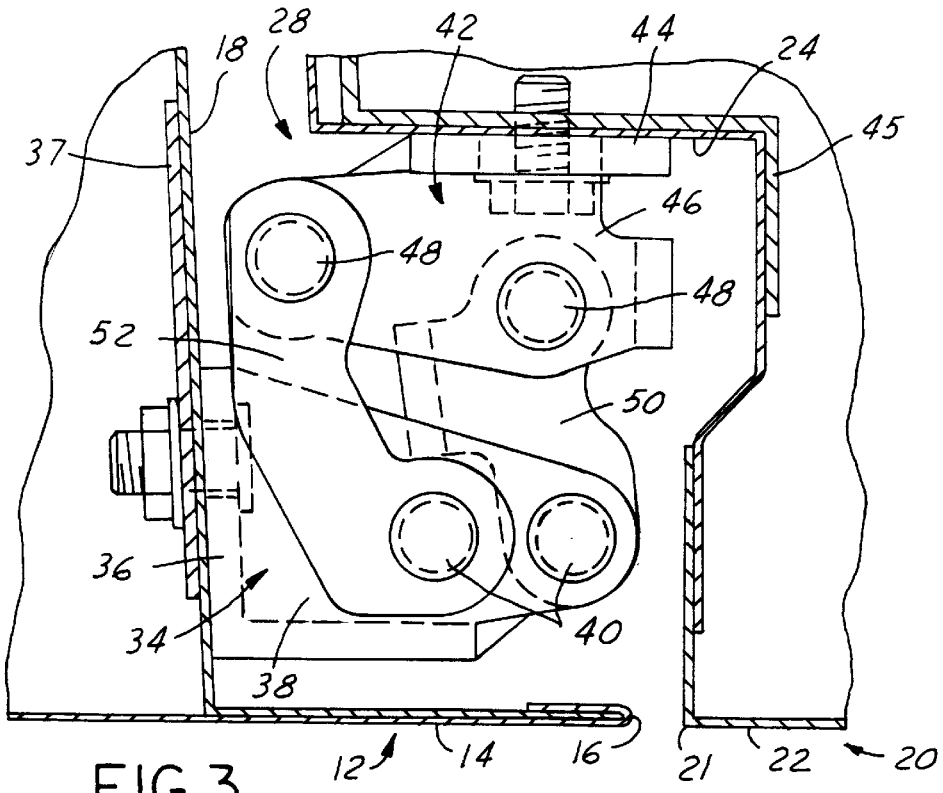
FIG. 3 is top view of an articulated door hinge in a closed position according to the present invention.

Turning now to the drawings, and in particular to FIG. 1 thereof, an automotive vehicle 10 is shown having a third side door 12. As shown in FIGS. 2 and 3 the side door 12 has an outer surface 14 with a leading edge 16 and an inner surface 18. As further shown in FIGS. 2 and 3 the vehicle 10 has a pillar 20 having an outer surface 22 and an inner surface 24. As shown in FIG. 2, an articulating hinge 26 connects the side door 12 to the pillar 20.

The articulating hinge 26, shown in FIG. 2, has an upper and a lower hinge mechanism, 28 and 30 respectively, and a torsional support shaft 32 connecting the two mechanisms 28 and 30. Each hinge mechanism is interchangeable between upper and lower as well as right and left vehicle sides. The following description of the upper hinge mechanism 28, therefore, corresponds to the lower mechanism 30 and to the right and left side mechanisms.

As shown in FIG. 3, the upper hinge mechanism 28 has a door half linkage 34 having a base 36 rigidly attached to the door 12 inner surface 18 and a bearing surface 38 projecting from the base 36 supporting a pair of horizontally spaced rotary center shafts 40. A support plate 37 may be employed to structurally reinforce the door half linkage 34 attachment to the door 12. The hinge mechanism 28 also has a pillar half linkage 42 having a base 44 rigidly attached to the pillar 20 inner surface 24 and a bearing surface 46 projecting from the base 44 supporting a pair of horizontally spaced rotary center shafts 48. A support plate 45 may be employed to structurally reinforce the pillar half linkage 42 attachment to the pillar 20. As still shown in FIG. 3, a forward link 50 connects longitudinally forward most rotary center shafts, 48 and 50, of the door half linkage 34 to the pillar half linkage 42. A rearward link 52 connects longitudinally rearward most rotary center shafts, 40 and 48, of the door half linkage 34 to the pillar half linkage 42. It is noted that a predetermined gap or distance exists between the door 12 leading edge 16 and the longitudinally rearward most edge 21 of the pillar 20 outer surface 22. The predetermined distance is from a range from 1 to 5 milliliters.

Figure 4:
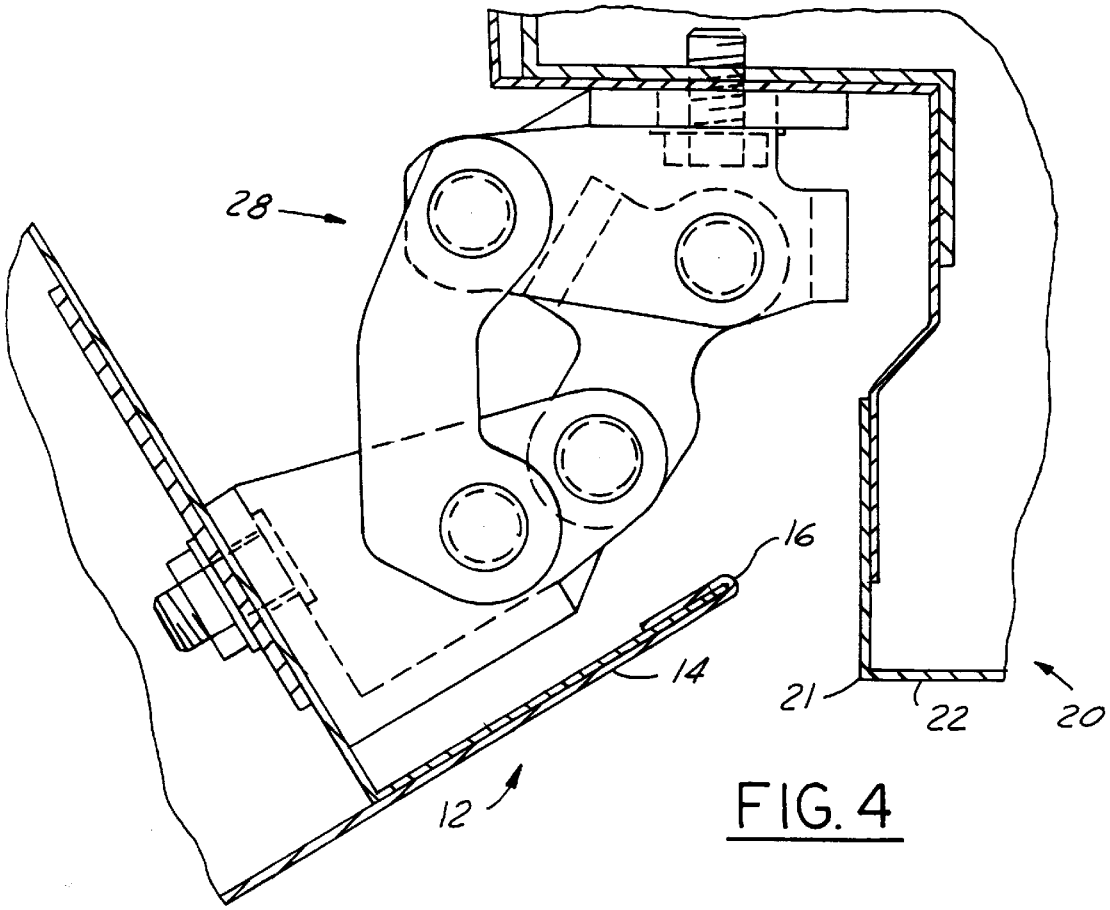
FIG. 4 is top view of an articulated door hinge in a partial open position according to the present invention.
Figure 5:
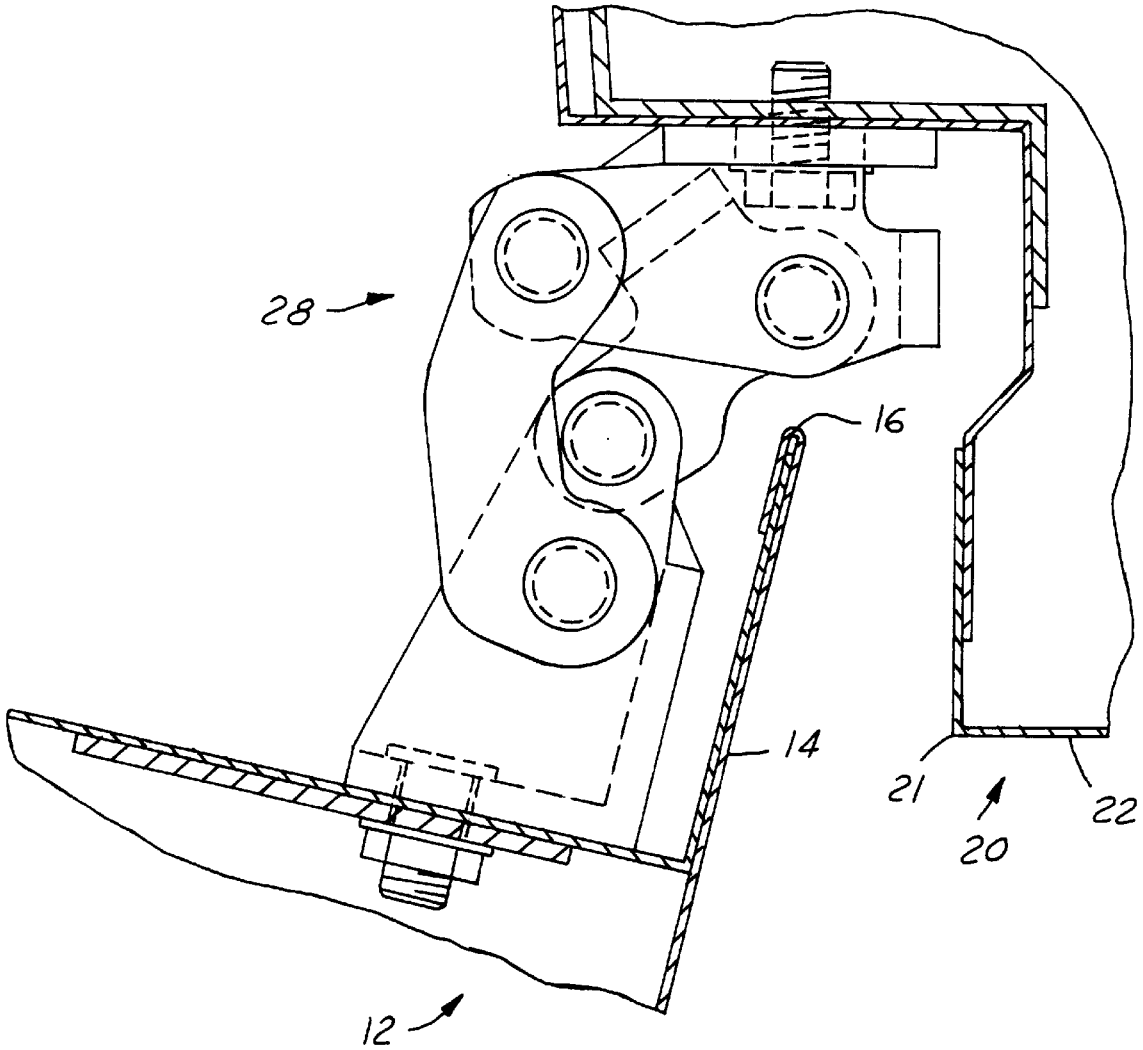
FIG. 5 is top view of an articulated door hinge in a full open position according to the present invention.

As mentioned above the upper hinge mechanism 28 is connected to a lower hinge mechanism 30 by a support shaft 32 to form an articulating vehicle door hinge 26. As shown in FIG. 3, the door hinge 26 is shown in a door closed position. In the door closed position the door outer surface 14 is a predetermined distance from and preferably flush with the pillar 20 outer surface 22. As shown in FIG. 4, as the door 12 is opened the door outer surface leading edge 16 moves laterally inward and rearward of the pillar rearward edge 21. As shown in FIG. 5, the door hinge 26 is shown in a door fully open position where the leading edge 16 rests in a laterally inward and rearward position relative to the rearward edge 21.

The present invention advantageously prevents the outer door leading edge 16 from interfering with any type of pillar structure by moving the leading edge laterally inward and rearward of the pillar rearward edge 21 upon door 12 opening. Furthermore, the present invention prevents vehicle door sag upon door opening, and through all door opening positions, by providing a torsional support shaft 32 that connects upper and lower hinge mechanisms, 28 and 30 respectively. Finally, the present invention advantageously uses interchangeable components to form the upper and lower as well as the right and left hinge mechanisms thereby reducing tooling and part cost.

Only one embodiment of the articulating vehicle door hinge of the present invention has been described. Those skilled in the automotive arts will appreciate that others may be possible without departing from the scope of the following claims.

We claim:

1. An articulated door hinge attaching a vehicle door having an outer surface with a leading edge and an inner surface to a vehicle pillar having an outer surface and an inner surface, the door hinge comprising:

a pillar half linkage having a base rigidly attached to the pillar inner surface and a bearing surface projecting from the base supporting a pair of horizontally spaced rotary center shafts;

a door half linkage having a base rigidly attached to the door inner surface and a bearing surface projecting from the base supporting a pair of horizontally spaced rotary center shafts;

a forward link connecting corresponding longitudinally forward most rotary center shafts of the door half linkage to the pillar half linkage;

a rearward link connecting corresponding longitudinally rearward most rotary center shafts of the door half linkage to the pillar half linkage thereby creating an articulated door hinge;

the articulated door hinge operable between a door closed position where the door outer surface leading edge is a predetermined distance from the pillar outer surface and a door open position where the door outer surface leading edge is moved laterally inward and longitudinally rearward of the pillar outer surface;

wherein the door outer surface leading edge moves continuously laterally inward and rearward of the pillar outer surface during the entire range of motion as the door moves from the door closed position to the door open position.

2. An articulated door hinge according to claim 1 wherein the predetermined distance increases between door closed and door opened positions.

3. An articulated door hinge according to claim 2 wherein the predetermined distance is chosen from a range from 1 to 5 millimeters.

4. An articulated door hinge according to claim 1 wherein the door half linkage and pillar half linkage are correspondingly interchangeable between right and left vehicle door sides.

5. An articulated door hinge attaching a vehicle door having an outer surface with a leading edge and an inner surface to a vehicle pillar having an outer surface and an inner surface, the door hinge comprising:

an upper and a lower pillar half linkage each having a base rigidly attached to the pillar inner surface and a bearing surface projecting from the base supporting a pair of horizontally spaced rotary center shafts;

an upper and a lower door half linkage each having a base rigidly attached to the door inner surface and a bearing surface projecting from the base supporting a pair of horizontally spaced rotary center shafts;

an upper and a lower forward link each connecting corresponding upper and lower longitudinally forward most rotary center shafts of the door half linkage to the pillar half linkage;

an upper and a lower rearward link each connecting corresponding upper and lower longitudinally rearward most rotary center shafts of the door half linkage to the pillar half linkage thereby creating an articulated door hinge;

the articulated door hinge operable between a door closed position where the door outer surface leading edge is a predetermined distance from the pillar outer surface and a door open position where the door outer surface leading edge is moved laterally inward and longitudinally rearward of the pillar outer surface;

wherein the door outer surface leading edge moves continuously laterally inward and rearward of the pillar outer surface during the entire range of motion as the door moves from the door closed position to the door open position.

6. An articulated door hinge according to claim 5 wherein the predetermined distance increases between door closed and door opened positions.

7. An articulated door hinge according to claim 6 wherein the predetermined distance is chosen from a range from 1 to 5 millimeters.

8. An articulated door hinge according to claim 5 wherein the upper and lower door half linkages and pillar half linkages are correspondingly interchangeable between upper and lower as well as right and left vehicle door sides.

9. An articulated door hinge attaching a vehicle door having an outer surface with a leading edge and an inner surface to a vehicle pillar having an outer surface and an inner surface, the door hinge comprising:

an upper and a lower pillar half linkage each having a base rigidly attached to the pillar inner surface and a bearing surface projecting from the base supporting a pair of horizontally spaced rotary center shafts;

an upper and a lower door half linkage each having a base rigidly attached to the door inner surface and a bearing surface projecting from the base supporting a pair of horizontally spaced rotary center shafts;

an upper and a lower forward link each connecting corresponding upper and lower longitudinally forward most rotary center shafts of the door half linkage to the pillar half linkage;

an upper and a lower rearward link each connecting corresponding upper and lower longitudinally rearward most rotary center shafts of the door half linkage to the pillar half linkage thereby creating upper and lower hinge mechanisms;

a torsional support shaft connecting upper and lower hinge mechanisms thereby creating a unitary articulated door binge;

the articulated door hinge operable between a door closed position where the door outer surface leading edge is a predetermined distance from the pillar outer surface and a door open position where the door outer surface leading edge is moved laterally inward and longitudinally rearward of the pillar outer surface;

wherein the door outer surface leading edge moves continuously laterally inward and rearward of the pillar outer surface during the entire range of motion as the door moves from the door closed position to the door open position.

10. An articulated door hinge according to claim 9 wherein the predetermined distance increases between door closed and door opened positions.

11. An articulated door hinge according to claim 10 wherein the predetermined distance is chosen from a range from 1 to 5 millimeters.

12. An articulated door hinge according to claim 9 wherein the unitary articulated door hinge is interchangeable between right and left vehicle door sides.

13. An articulated door hinge according to claim 1 wherein the pair of horizontally spaced rotary center shafts supported by the bearing surface of the pillar half linkage is supported between an upper portion and a lower portion of the bearing surface of the pillar half linkage, and the pair of horizontally spaced rotary center shafts supported by the bearing surface of the door half linkage is supported between an upper portion and a lower portion of the bearing surface of the door half linkage.

14. An articulated door hinge according to claim 5 wherein the pair of horizontally spaced rotary center shafts supported by the bearing surface of the pillar half linkage is supported between an upper portion and a lower portion of the bearing surface of the pillar half linkage, and the pair of horizontally spaced rotary center shafts supported by the bearing surface of the door half linkage is supported between an upper portion and a lower portion of the bearing surface of the door half linkage.

15. An articulated door hinge according to claim 9 wherein the pair of horizontally spaced rotary center shafts supported by the bearing surface of the pillar half linkage is supported between an upper portion and a lower portion of the bearing surface of the pillar half linkage, and the pair of horizontally spaced rotary center shafts supported by the bearing surface of the door half linkage is supported between an upper portion and a lower portion of the bearing surface of the door half linkage.

* * * * *